US011273361B2

(12) United States Patent
Johnson

(10) Patent No.: US 11,273,361 B2
(45) Date of Patent: Mar. 15, 2022

(54) SNOWSPORT EQUIPMENT POSITIONAL STABILIZATION

(71) Applicant: AJAJA, LLC, Denver, CO (US)

(72) Inventor: Avery C. Johnson, Denver, CO (US)

(73) Assignee: AJAJA, LLC, Denver, CO (US)

( * ) Notice: Subject to any disclaimer, the term of this patent is extended or adjusted under 35 U.S.C. 154(b) by 250 days.

(21) Appl. No.: 16/501,655

(22) Filed: May 20, 2019

(65) Prior Publication Data

US 2020/0368606 A1 Nov. 26, 2020

(51) Int. Cl.

| | |
|---|---|
| ***A63C 11/00*** | (2006.01) |
| ***A63C 10/28*** | (2012.01) |
| ***A63C 11/16*** | (2006.01) |

(52) U.S. Cl.

CPC ..... *A63C 10/28* (2013.01); *A63C 11/16* (2013.01)

(58) Field of Classification Search

CPC ..... A63C 10/28; A63C 11/16; A63C 11/00; A63C 7/12; A63C 7/00; A63C 7/1066; A63C 7/108; A63C 7/10

See application file for complete search history.

(56) References Cited

U.S. PATENT DOCUMENTS

| | | | | |
|---|---|---|---|---|
| 3,760,513 | A * | 9/1973 | Corneliusen | A63C 13/003 36/124 |
| 5,356,168 | A | 10/1994 | Ozburn | |
| 5,816,602 | A | 10/1998 | Hayashi | |
| 6,007,101 | A * | 12/1999 | Pritchard | A63C 5/03 280/14.22 |
| 6,220,631 | B1 * | 4/2001 | Pritchard | A63C 5/03 280/14.22 |
| 6,264,215 | B1 * | 7/2001 | Carlson | A63C 5/03 280/14.21 |
| 6,695,323 | B2 * | 2/2004 | Backlund | A63C 7/1066 188/6 |
| 6,702,328 | B2 * | 3/2004 | Malleis | A63C 11/00 280/14.21 |
| 6,957,818 | B2 * | 10/2005 | McClure | B62B 15/009 280/14.28 |
| 8,474,853 | B2 | 7/2013 | Rogers et al. | |
| 8,556,295 | B2 | 10/2013 | Johnson | |
| 8,590,936 | B2 * | 11/2013 | Payson | A63C 7/08 280/809 |
| 9,205,321 | B2 * | 12/2015 | Geiger | A63C 10/28 |
| 9,545,561 | B2 * | 1/2017 | Edmonston | A63C 10/28 |
| 10,328,331 | B2 * | 6/2019 | Hitch | A63C 7/1086 |
| 10,413,805 | B2 * | 9/2019 | James | A63C 11/26 |
| 2002/0175497 | A1 | 11/2002 | Freemon | |
| 2005/0173917 | A1 | 8/2005 | Kovall et al. | |
| 2006/0071449 | A1 | 4/2006 | Backlund | |
| 2007/0075524 | A1 | 4/2007 | Kelly | |
| 2007/0096432 | A1 | 5/2007 | Wilson | |

* cited by examiner

*Primary Examiner* — James M Dolak
(74) *Attorney, Agent, or Firm* — Harold A. Burdick

(57) ABSTRACT

Apparatus and methods are disclosed for positionally stabilizing snowsport equipment such as snowboards while in use on snow or ice. The apparatus includes a position establishing unit having an interface and a guide situated in an angular relation to one another and a tether connectable between the establishing unit and either the equipment or an article associated with the user.

13 Claims, 7 Drawing Sheets

SNOWSPORT EQUIPMENT POSITIONAL STABILIZATION

FIELD OF THE INVENTION

This invention relates to snowsport equipment such as snowboards, skis and sleds, and, more particularly, relates to apparatus and methods for positional stabilization of such equipment while in use on snow or ice.

BACKGROUND OF THE INVENTION

The popularity of winter snowsports is booming worldwide. These sports include a variety of endeavors including skiing, snowboarding, sledding and the like utilizing a wide variety of equipment. Learning the sports and equipment utilization takes time and effort. Particularly, equipment use (mounting, dismounting and the like) can be discouraging to some. For example, with skis and snowboards, the process affixing the equipment bindings to the user's footwear can be a frustrating experience, particularly for those new to the sport, as the surface upon which they are endeavoring and the bottoms of the equipment are both slick which causes the equipment to move relatively easily as the user labors to establish connections.

These difficulties are particularly troubling for snowboarders because they have no way of bracing themselves (both feet are held at a single location) other than to sit, mount or dismount, and rise. Since they typically must release at least one binding each time they mount a resort lift, this can become tiring over the course of the day.

Some anchors or stops have been heretofore suggested to assist boarders in this regard (see U.S. Pat. No. 8,556,295 for example). Various means of braking a board have also been heretofore suggested (see, for example, U.S. Pat. Nos. 5,356,168, 5,816,602, 6,092,828, 9,205,321, 8,157,285, 8,286,989, 5,145,202, and 6,279,924 and U.S. Patent Publication Nos. 2002/0175497, 2006/0071449, 2007/0075524, and 2007/0096432). Mechanisms for creating traction (skins and pads, for example) for use in a variety of applications are also known (see U.S. Pat. Nos. 8,474,853, 9,895,595, 2,326,802, 6,471,234, 8,215,568, 3,202,358, and 3,708,117, and U.S. Patent Publication Nos. 2006/0082103 and 2006/0267332 for example). Tethers are used in conjunction with a number of these to prevent escape of the board (see the foregoing as well as U.S. Patent Publication No. 2005-0173917 for example).

While these various mechanisms have proved useful in some applications, they are not all readily adaptable for application to snowsport equipment of certain types where ongoing activity will occur. Those directly adapted for restriction of snowboard movement do not restrict lateral linear sliding as well as rotational movement. Most do not accommodate immediate deployment for momentary stabilization of the equipment during a particular operation and just as immediate disengagement. Finally a number of the heretofore known applications require permanent mountings on the equipment and/or are not readily storable during ongoing use of the equipment by the user at all. Further improvement could thus still be utilized.

SUMMARY OF THE INVENTION

This invention provides apparatus and methods for positionally stabilizing snowsport equipment such as snowboards, split boards, skis, mono-skis, sleds, skeletons, luges and the like having a linear edge while in use by a user on snow or ice. The apparatus includes a position establishing unit having an interface and a guide situated in an angular relation to one another. The interface is removably locatable between the equipment and the snow or ice while the guide is positionable adjacent to the linear edge of the equipment. A tether is connectable between the establishing unit and either the equipment or the user. The best mode of the apparatus shown herein is particularly well adapted for use in stabilizing a snowboard while in use but could be as easily adapted to other snowsport equipment.

The establishing unit interface includes top and bottom surfaces with retaining structure established thereat, a wedge formation and cleats projecting from the bottom surface. The tether is preferably a retractor and tether cord connectable to the retaining structure of the interface. The retractor houses a length of the cord and is adapted for user unspooling of a selected quantity of the cord and automatic selective respooling thereof.

The method of this invention includes the steps of establishing a selected equipment position and stabilizing the position using an interface removably locatable beneath the equipment between the equipment and the snow or ice, and maintaining the equipment at a selected location on the interface using a guide associated with the interface. The guide is positionable adjacent to the linear edge of the equipment, and the interface is tethered to one of the equipment and the user.

It is therefore an object of this invention to provide apparatus and methods for positionally stabilizing snowsport equipment having a linear edge while in use by a user on snow or ice.

It is another object of this invention to provide apparatus and methods for positionally stabilizing a snowboard while in use by a user on snow or ice.

It is another object of this invention to provide apparatus and methods for positionally stabilizing a snowboard while in use by a user on snow or ice adapted for restriction of lateral linear sliding as well as rotational movement of the snowboard.

It is still another object of this invention to provide apparatus for positionally stabilizing snowsport equipment that accommodates immediate deployment and disengagement of the apparatus for momentary stabilization of the equipment during a particular operation.

It is yet another object of this invention to provide apparatus for positionally stabilizing snowsport equipment that requires no permanent mountings on the equipment and that is readily storable during ongoing use of the equipment by the user.

It is another object of this invention to provide an apparatus for positionally stabilizing snowsport equipment having a linear edge while in use by a user on snow or ice that include a position establishing unit having an interface and a guide situated in an angular relation to one another, the interface removably locatable beneath the equipment between the equipment and the snow or ice, and the guide positionable adjacent the linear edge of the equipment, and a tether connectable between the establishing unit and one of the equipment and the user.

It is still another object of this invention to provide an apparatus for positionally stabilizing a snowboard having a linear edge while in use by a user on snow or ice that includes a position establishing unit having an interface and a guide situated in an angular relation to one another, the interface including top and bottom surfaces with retaining structure established thereat, a wedge formation and cleats projecting from the bottom surface, the interface removably locatable beneath the snowboard between the snowboard and the snow or ice with the guide positionable adjacent the linear edge of the snowboard, and a retractor and tether cord connectable between the retaining structure of the interface and one of the snowboard and the user, the retractor for housing a length of the cord and for user unspooling of a selected quantity of the cord and automatically selectively respooling the cord.

It is yet another object of this invention to provide a method for positionally stabilizing snowsport equipment having a linear edge while in use by a user on snow or ice that includes the steps of establishing a selected equipment position and stabilizing the position using an interface removably locatable beneath the equipment between the equipment and the snow or ice, maintaining the equipment at a selected location on the interface by positioning a guide associated with the interface adjacent to the linear edge of the equipment, and tethering the interface to one of the equipment and the user.

With these and other objects in view, which will become apparent to one skilled in the art as the description proceeds, this invention resides in the novel construction, combination, and arrangement of parts and methods substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
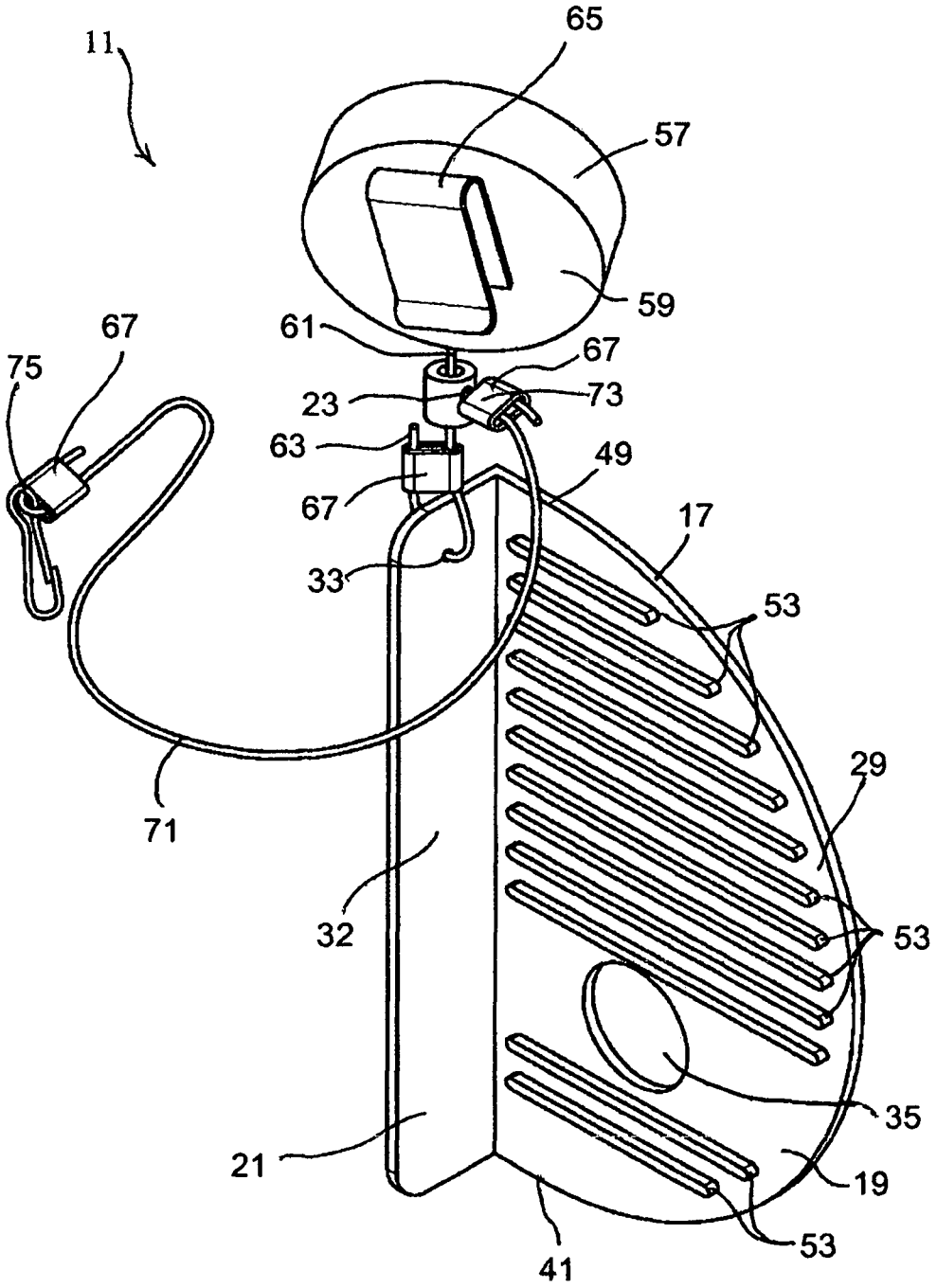
FIG. 1 is a perspective view of the apparatus of this invention.
Figure 2:
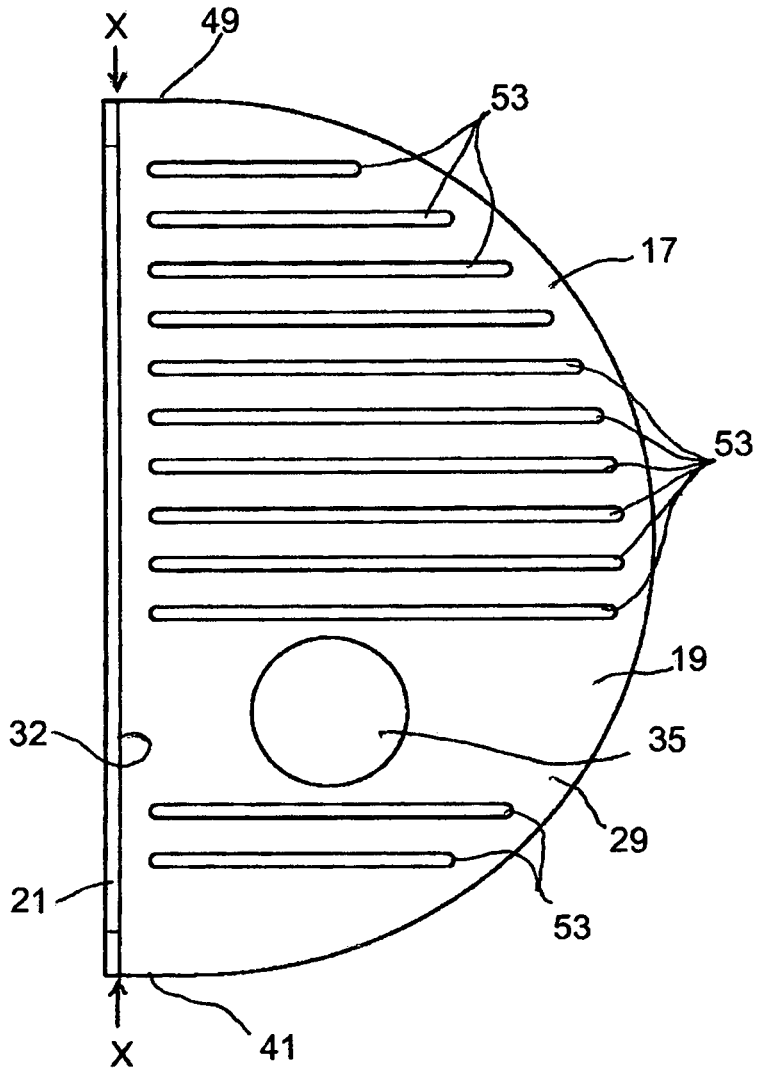
FIG. 2 is a top view of the establishing unit of the apparatus of this invention shown in FIG. 1.
Figure 3:
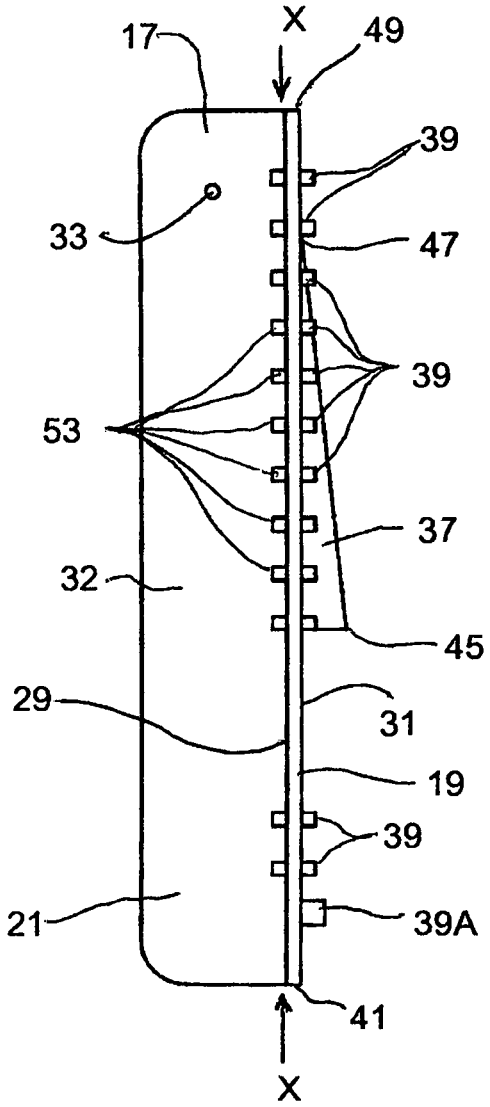
FIG. 3 is a side view of the establishing unit shown in FIG. 2.
Figure 4:
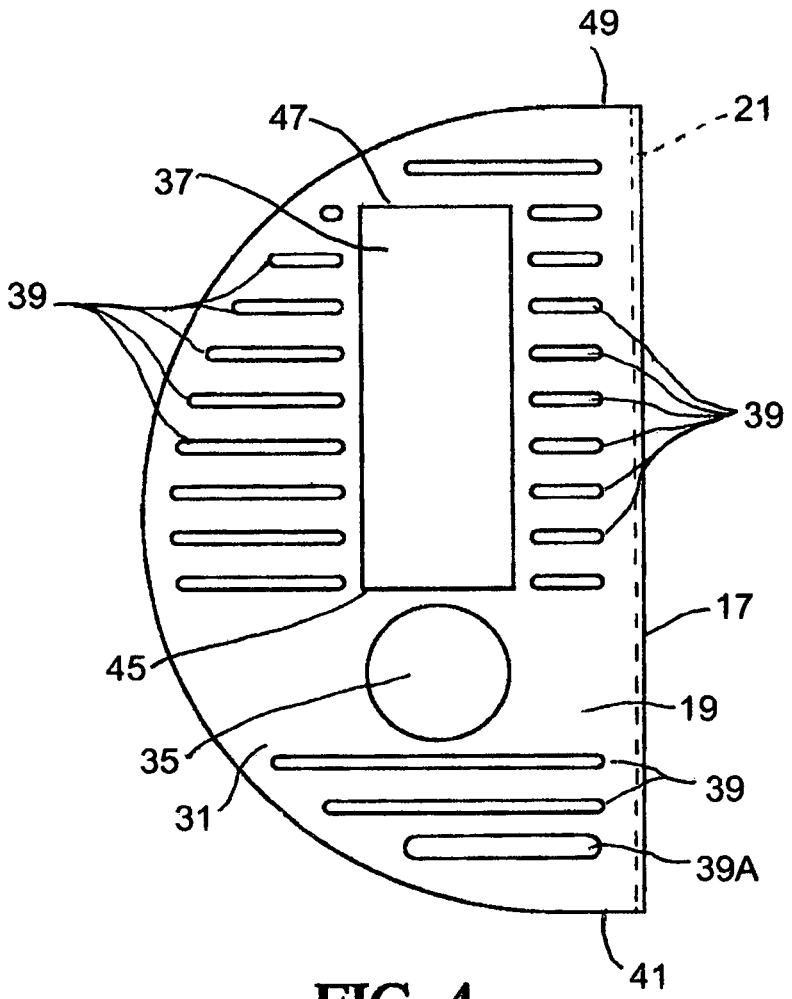
FIG. 4 is a bottom view of the establishing unit shown in FIG. 2.
Figure 5:
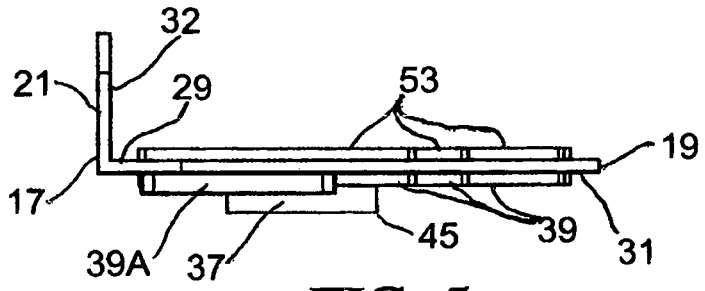
FIG. 5 is an end view of the establishing unit shown in FIG. 2.
Figure 6:
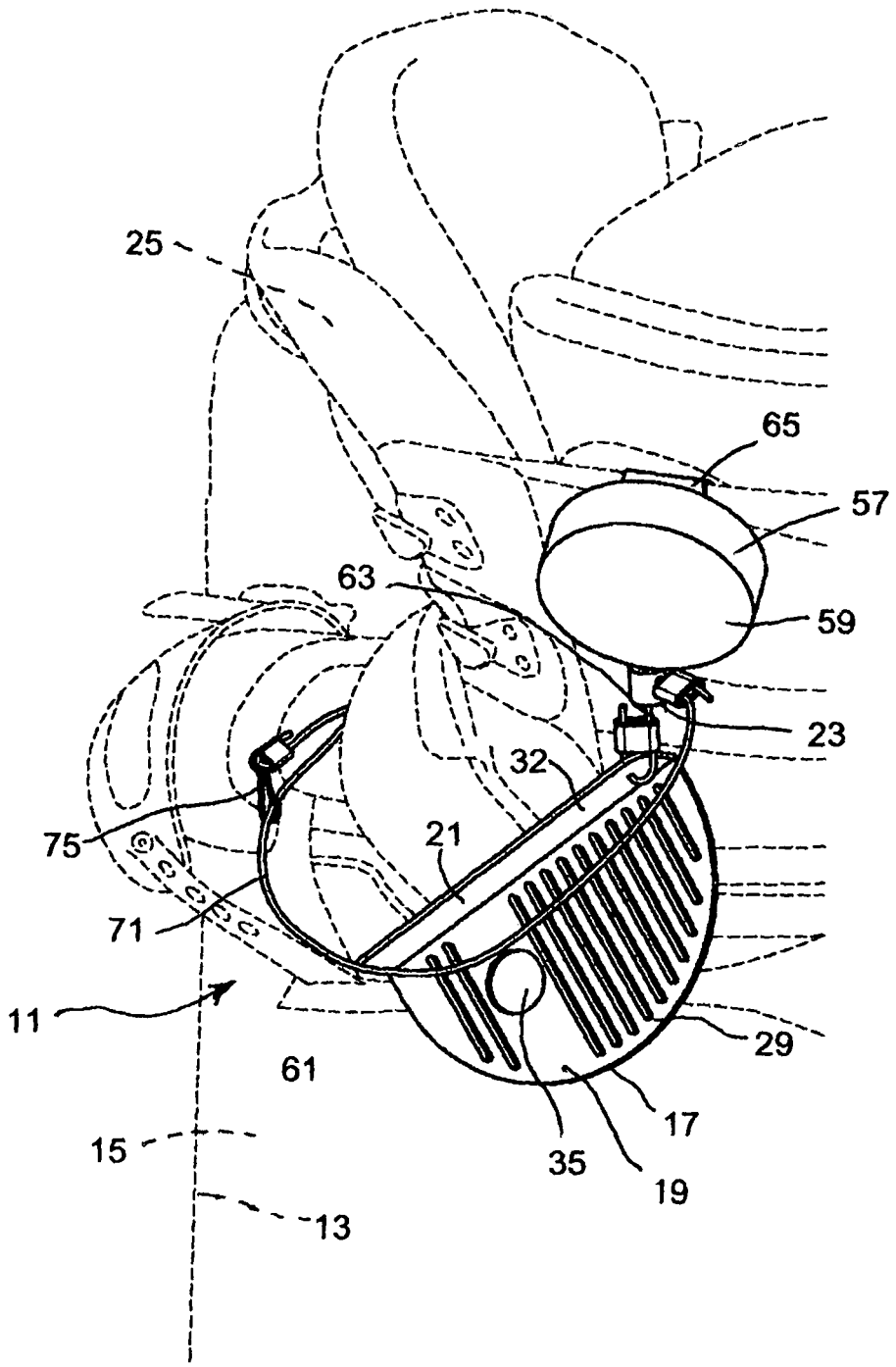
FIGS. 6 through 8 are perspective views illustrating mounting and use of the apparatus of this invention.
Figure 7:
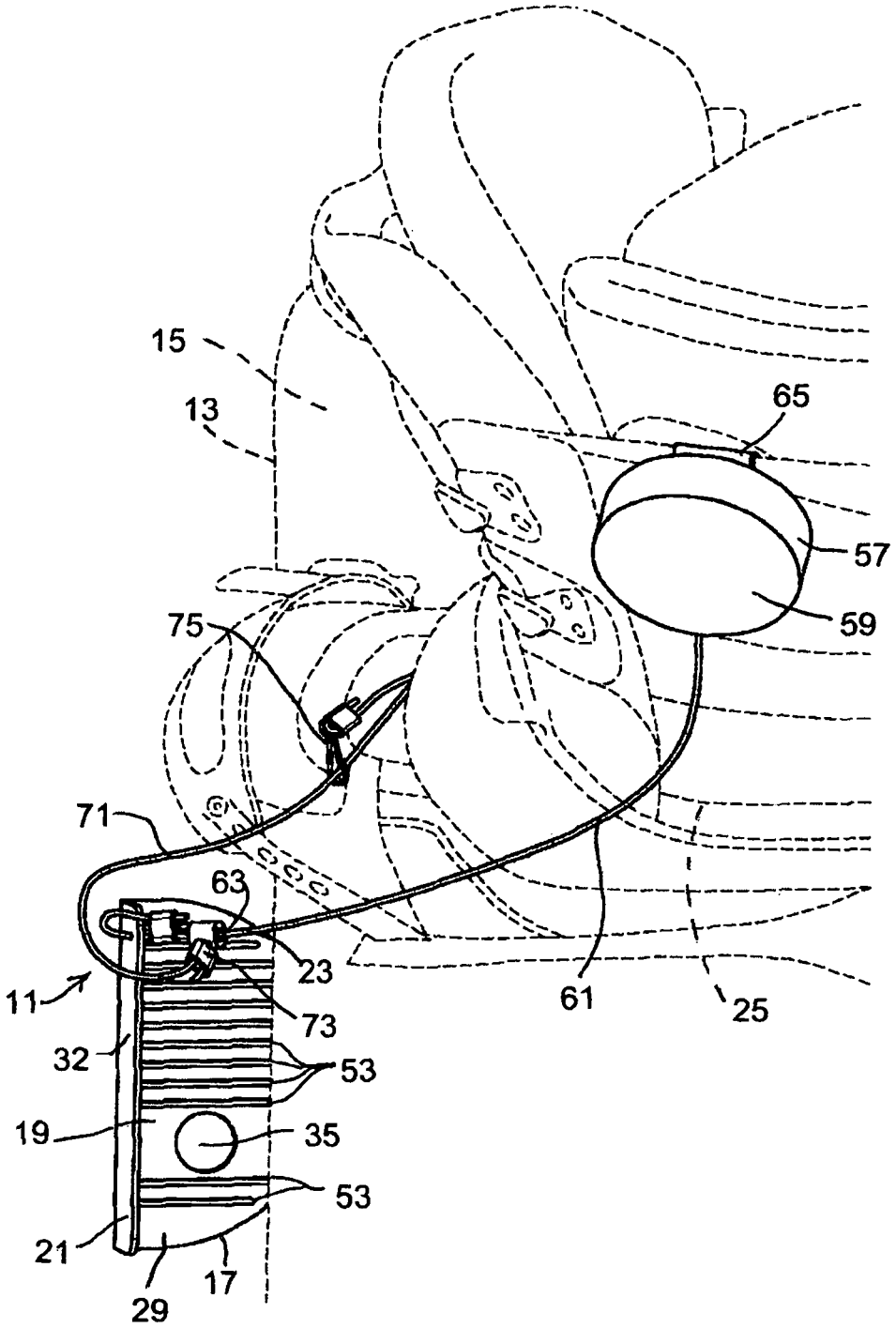
Figure 8:
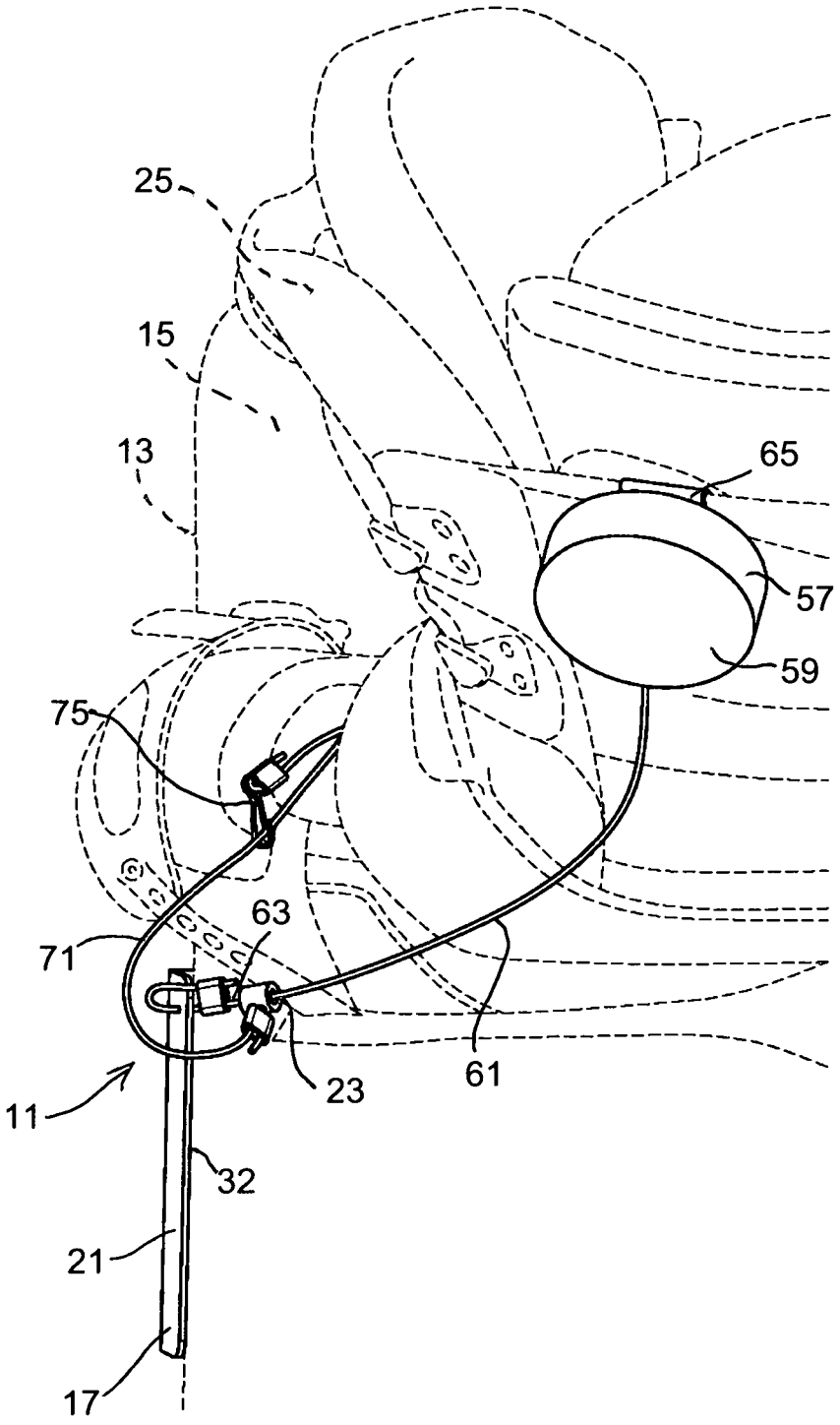

Apparatus 11 of this invention as illustrated in the FIGURES is adapted for positionally stabilizing, against both from lateral linear sliding and rotational movement, snowsport equipment such as snowboards, split boards, skis, mono-skis, sleds, skeletons, luges and the like while in use by a user of the equipment. All such equipment is characterized by a linear edge at the equipment (edge 13 of snowboard 15 as shown in FIGS. 6 through 8, ski or runner edges, or a sled body, for example). As illustrated herein, apparatus 11 is particularly well adapted for use with snowboards.

Apparatus 11 includes position establishing unit 17 having interface (also referred to as an interface platform herein) 19 and guide 21 situated in an angular relation (preferably substantially perpendicular) to one another. Tether assemblage 23 (preferably a primary and secondary tether cord or cable as discussed hereinafter) is connectable between establishing unit 17 and either the equipment or the user (or, preferably, an article associated with the user such as a ski boot or snowboard boot 25 as seen in FIGS. 6 through 8). Interface 19 is preferably formed as a semicircular platform having top and bottom surfaces 29 and 31, respectively. Guide 21 has planar elongated contact surface 32 adjacent to top surface 29. Retaining structure 33 (an opening, shown herein through guide 21 though it could as well be formed through interface platform 19) is established at unit 17. Traction assist opening 35 is established through interface platform 19 between the top and bottom surfaces 29 and 31, Wedge formation 37 and a plurality of cleats 39 are formed projecting from bottom surface 31 of interface platform 19.

Cleats 39 extend parallel to one another across bottom surface 31 of interface platform 19. Most of cleats 39 are standard sized relative to one another. However, cleat 39A adjacent to platform end 41 is larger, both in width and length of projection from bottom surface 31, than standard sized cleats 39.

Cleats 39/39A are provided to dig into the snow and thus prevent forward and rearward equipment slipping movement. Opening 35 is likewise provided to increase surface retention to prevent linear slipping movement in all lateral directions by allowing compacted snow to rise into the hole responsive to downward pressure applied by weight of the user. Wedge formation 37 further restricts forward and rearward equipment slipping movement when downward force is applied. The combination of opening 35, wedge formation 37 and rearward cleat 39A essential trap snow therebetween when applied in such a way as to inhibit (in association with cleats 39 and guide 21) both lateral and rotational movement of the equipment/snowboard.

Top surface 29 of interface platform 19 is positioned in contact with the equipment (snowboard 15 for example as shown in FIGS. 7 and 8) when the unit 17 is deployed. Top surface 29 has a plurality of parallel ridges 53 defined therein during unit formation extending across the surface. These ridges prevent snow and water from making complete/constant contact between surface 29 and the bottom surface of the equipment when deployed so that at least some portion of top surface 29 of interface platform 19 remains in direct, non-slipping contact therewith to restrict snowboard shifting on the pad. Ridges 53 project about the same distance from surface 29 as cleats 39 do from surface 31.

Preferred measurements of the various structures identified above are best expressed relative to diameter X of the semicircle defining interface platform 19 (see FIGS. 2 through 5) since this also defines the maximum length of the platform no matter is geometry and also accommodates various size units. For example, diameter X is preferably no less than about 10 cm for use with full size snowboards (test units have been produced with a diameter of about 11.5 cm). Using this standard then, guide 21 height from surface 29 is about 0.17× and interface platform 19 maximum width from guide 21 is 0.5×. Wedge formation 37 ramp length is about 0.52× with ramp width about 0.17×. Wedge formation height to incline plane peak 45 above surface 31 is about 0.034×. Circular opening 35 has a diameter of about 0.17×. Standard cleat 39 height above surface 31 is about 0.017× while cleat 39A height above surface 31 is about 0.026×. Cleats 39/39A vary in length as is shown from about 0.017× to about 0.39× (cleat 39A is about 0.23×).

Retractor unit 57 and tether cord or cable assemblage 23 are affixed at retaining structure 33 of interface 19 at one terminus and to either equipment/snowboard 15 or the user (via boot 25 for example) at another terminus. Retractor unit 57 can be any of a number of known automatic cable/cord retracting units available in commerce and includes housing 59 for maintaining a spooled length of cord 61 therein readily unspooled by a user pulling on free end 63 of cord 61 (essentially by grasping and pulling on unit 17. The cord is automatically respooled when released as is known with such devices. Retractor unit 57 is preferably provided with mounting clip 65 when used snowboards or skis for mounting of unit 57 on a ski or snowboard boot. A cable clip or cord crimp 67 is used at end 63 to maintain cord 61 at retaining structure 33 (looped therethrough). Similar such clips or crimps are used to secure tether ends as shown in the FIGURES.

Secondary safety tether cord or cable 71 is connected at one end at end 63 of cord 61 via clip assemblage 73. Spring hook clip assemblage 75 at its opposite end accommodates securement at a wearable item associated with the user (such as boot 25 (see FIGS. 6 through 8). By this means, if retractor unit 57 becomes dislodged from its mounting location securement of apparatus 11 with the equipment is maintained.

Turning attention now to FIGS. 6 through 8, the description of the methods of this invention for positionally stabilizing snowsport equipment having a linear edge while in use by a user on snow or ice will proceed. As seen, a selected equipment position is established and stabilized using interface 19 removably locatable beneath the equipment between the equipment and the snow or ice (FIG. 7). The equipment is maintained thereat at a selected location on interface 19 by positioning guide 21 adjacent to linear edge 13 of equipment 15 (FIG. 8). Interface 19 remains tethered to either one of equipment 15 or a user (via boot 25, for example), so that upon release from beneath the equipment it is returnable to a stored position at the equipment (FIG. 6).

Guide 21 serves dual purposes of restricting rotational movement of the equipment in combination with other elements and preventing unit 17 from sliding completely under the equipment. The method further includes using tether cord or cable 61 having a length and selectively extending and retracting cord 61 from a location, for example by user unspooling a selected quantity of the cord and thereafter selectively respooling the cord. Unit 17 is preferably secondarily tethered to the equipment or user.

Parallel ridges at top surface 29 of interface 19 are formed during manufacture. Enhanced traction at the interface 19 is created by at least one of establishing plurality of cleats at surface 31 of the interface 19, establishing opening 35 through interface 19, and/or establishing wedge formation 37 at a surface 31.

In use with snowboard equipment, apparatus 11 is attached to an inside edge of the user's front boot at clip 65 and retractor unit 57. During snowboarding, apparatus 11 is held close to the users boot 25 (FIG. 6) adjacent to retractor unit 57 near the top inside of boot 25. Safety tether cord or cable 71 spring hook clip assemblage 75 is inserted under a binding/boot element (laces of boot 25, for example) and clipped to cord/cable 71. Unit 17 is released from its stored location when the user unspools a selected length of cord or cable 61 or retractor unit 57 and is placed by the user under the front edge of snowboard 15 near the toe of boot 25. Snowboard 25 is maneuvered so that guide surface 32 is positioned next to the snowboard liner edge 13. The user then exerts his/her weight on the front foot causing the interface 19 traction element at bottom surface 31 thereof to dig into the snow providing the friction and drag to keep the snowboard from sliding or rotating on the snow.

If gearing up, the snowboarder now can fasten the free trailing foot into the empty snowboard binding and secure it (the reverse operation of the snowboarder is stopping or mounting a lift). Once the snowboarder's free foot is secure, the snowboarder can maneuver the front of the snowboard off unit 17 by balancing on the back edge of the snowboard and lifting the front edge or hopping off it. When unit 17 is free it will retract back up towards the side of boot 25.

As may be appreciated from the foregoing, improved means for restricting undesired movement of snowsport equipment during user operations has been provided. The apparatus of this invention is relatively inexpensive to produce, unit 17 being formed (injection molded) from a single piece of flexible material such as neoprene, synthetic rubber materials, rubber, semi rigid but flexible plastics or the like. There are no parts fixed to unit 19 aside from the tether assemblage attached at a single opening through the unit. Cord/cables are preferably heavy nylon cord, though any suitable cord or cable material could be utilized. While tethering is shown in association with a user's boot, all retractors and cords could instead be affixed at a permanent location established on the equipment.

What is claimed is:

1. An apparatus for positionally stabilizing snowsport equipment having a linear edge while in use by a user on snow or ice comprising:

a position establishing unit having a retaining structure, an interface and a guide, said interface and said guide situated in an angular relation to one another, said interface including top and bottom surfaces, a wedge formation and cleats projecting from said bottom surface, said interface further including a traction assist opening therethrough between said top and bottom surfaces, said wedge formation defining an incline plane oriented with an incline plane peak thereof adjacent to said opening and an incline plane origin thereof spaced therefrom so that said incline plane of said wedge formation runs parallel to said guide, said interface located when in use beneath the equipment between the equipment and the snow or ice, and said guide positioned when in use adjacent the linear edge of the equipment; and a tether including a tether cord connected when in use between said retaining structure and one of the snowboard and the user and a retractor associated with said tether cord for housing a length of said cord and for user unspooling of a selected quantity of said cord and automatically selectively respooling said cord.

2. The apparatus of claim 1 wherein said angular relation between said interface and said guide is perpendicular.

3. The apparatus of claim 1 wherein said tether includes a clip at one end releasably attachable to a wearable item and a clip at its opposite end secured at a free end of said cord.

4. The apparatus of claim 1 wherein said interface top surface having ridges extending thereacross.

5. The apparatus of claim 1 wherein said top surface of said interface is adjacent to said equipment when the unit is deployed, said top surface having a plurality of parallel ridges extending thereacross.

6. The apparatus of claim 1 further comprising a secondary tether connected at one end to an end of said tether cord and having a clip at an opposite end for securement at a wearable item associated with the user.

7. The apparatus of claim 1 wherein said angular relation of said guide and said unit is perpendicular and wherein said guide has a planar elongated contact surface adjacent to said top surface of said unit.

8. The apparatus of claim 1 wherein said interface is a semicircular platform, said cleats extending parallel one another across said bottom surface of said platform, one of said cleats adjacent an end of said platform projecting further from said bottom surface than others of said cleats.

9. An apparatus for positionally stabilizing a snowboard having a linear edge while in use by a user on snow or ice comprising:

a position establishing unit having an interface and a guide situated in an angular relation to one another, a wedge formation located at a bottom surface of said interface, said interface having a traction assist opening between a top surface of said interface and said bottom surface, said wedge formation defining an incline plane oriented with an incline plane peak thereof adjacent to said opening and an incline plane origin thereof spaced therefrom so that said incline plane of said wedge formation runs parallel to said guide, said interface located when in use beneath the snowboard between the snowboard and the snow or ice, and said guide positioned when in use adjacent the linear edge of the equipment; and a tether connected when in use between said establishing unit and one of the equipment and the user.

10. The apparatus of claim 9 wherein said tether includes retaining structures for tethering said position establishing unit to a user's boot.

11. The apparatus of claim 9 wherein said tether includes a tether cord having a length and a retractor housing a length of said cord for selectively extending and retracting said cord from a location.

12. The apparatus of claim 9 wherein spaced parallel ridges are located at a top surface of said interface.

13. The apparatus of claim 12 further comprising parallel spaced cleats projecting from said bottom surface of said interface.

* * * * *